US010451263B2

(12) United States Patent
Lan

(10) Patent No.: US 10,451,263 B2
(45) Date of Patent: Oct. 22, 2019

(54) LED LIGHT

(71) Applicant: Shenzhen Guanke Technologies Co., Ltd., Shenzhen (CN)

(72) Inventor: Qing Lan, Shenzhen (CN)

(73) Assignee: Shenzhen Guanke Technologies Co., Ltd., Shenzhen (CN)

( * ) Notice: Subject to any disclaimer, the term of this patent is extended or adjusted under 35 U.S.C. 154(b) by 113 days.

(21) Appl. No.: 15/648,406

(22) Filed: Jul. 12, 2017

(65) Prior Publication Data

US 2019/0003697 A1 Jan. 3, 2019

(30) Foreign Application Priority Data

Jun. 29, 2017 (CN) ..... 2017 2 0777626 U

(51) Int. Cl.

| | |
|---|---|
| ***F21V 17/02*** | (2006.01) |
| ***F21V 17/12*** | (2006.01) |
| ***F21V 19/00*** | (2006.01) |
| ***F21V 23/00*** | (2015.01) |
| ***F21V 23/06*** | (2006.01) |
| ***F21V 29/74*** | (2015.01) |
| ***F21V 29/83*** | (2015.01) |
| ***F21Y 115/10*** | (2016.01) |

(52) U.S. Cl.

CPC ..... *F21V 29/83* (2015.01); *F21V 17/02* (2013.01); *F21V 17/12* (2013.01); *F21V 19/006* (2013.01); *F21V 23/003* (2013.01); *F21V 23/06* (2013.01); *F21V 29/74* (2015.01); *F21Y 2115/10* (2016.08)

(58) Field of Classification Search

CPC ..... F21K 9/00; F21V 19/003; F21V 19/045; F21V 23/00; F21V 23/004; F21V 23/005; F21V 29/004; F21V 29/677; F21V 29/70; F21V 29/71; F21V 29/74; F21V 29/77; F21V 29/83; F21V 29/89; F21Y 2103/10; F21Y 2115/10

See application file for complete search history.

(56) References Cited

U.S. PATENT DOCUMENTS 7,434,964 B1 * 10/2008 Zheng ..... F21V 29/006 362/218
7,637,636 B2 * 12/2009 Zheng ..... F21S 2/005 362/294
7,810,968 B1 * 10/2010 Walker ..... F21V 21/30 362/431
9,593,839 B2 * 3/2017 Gallego Sanz ..... F21V 29/70
(Continued)

*Primary Examiner* — Bryon T Gyllstrom

(57) ABSTRACT

An LED light includes a holder, a plurality of bodies, an LED driver electrically connected the holder with the plurality of bodies, a housing receiving the LED driver therein, and a heat sink connected to the housing. The heat sink includes a first section opposite to the housing, and two second sections positioned two ends of the first section. The first section, the two second sections and the housing cooperatively form an elliptical-sectional cylinder. The first section includes a plurality of first horizontal passageways and each second section includes a second passageway provided to heat dissipation for the LED light. Such housing is mounted on the side of the heat sink to provide enough space for receiving the LED driver therein, which may avoid crush the LED driver and improve the lifespan of the LED light. The first and second passageways are provided to improve heat dissipation effects.

19 Claims, 5 Drawing Sheets

(56) References Cited

U.S. PATENT DOCUMENTS

| | | | | |
|---|---|---|---|---|
| 2005/0168985 | A1* | 8/2005 | Chen | F21V 19/001 362/241 |
| 2008/0316755 | A1* | 12/2008 | Zheng | F21V 29/004 362/373 |
| 2009/0323325 | A1* | 12/2009 | Long | F21K 9/00 362/234 |
| 2014/0293603 | A1* | 10/2014 | Barnard | F21V 29/74 362/241 |
| 2017/0268765 | A1* | 9/2017 | Luo | F21V 29/777 |

* cited by examiner

LED LIGHT

BACKGROUND

1. Technical Field

The present disclosure generally relates to light sources field, and especially relates to a Light-Emitting Diode (LED) light.

2. Description of Related Art

LED lights are used in various fields such as display devices, decorations, backlights and illuminations which are characterized by non-pollution, energy-saving, long lifespan and small in size. Such LED light, a high intensity of illumination can be obtained with a less amount of electric power and its lifespan reaches over three years without any particular repair, thereby providing a possibility and potentiality as a future illumination light. However, after used for a certain period of time, the LED light is deteriorated in the efficiency thereof. Also, when it is continuously operated, the amount of heat generated is gradually increased, thereby reducing the lifespan thereof. So, for illumination device with such LED lights, heat dissipation is a main factor should be considered. If the LED light device with a poor heat dissipation may affect the lifespan of the LED light device. Ventilation cooling is a good way to heat dissipation of the LED light device.

In general, in order to ensure the brightness and lifespan of the LED light, it's often needed to install an LED driver within the LED light. The LED driver may provide constant current to the LED light when the voltage is changed. However, the LED driver is installed in the lamp holder of the LED light, such narrow receiving space of the lamp holder may crush the LED driver so as to scrap the whole LED light, thereby it is needed to design a new installation of the LED driver for obtaining reliable connection.

SUMMARY

The disclosure relates to an LED light which may provide a rear installation to mount the LED driver thereon and improve heat dissipation effects.

In one aspect, an LED light includes: a holder and a plurality of bodies electrically connected to the holder. The LED light further includes an LED driver electrically connected the holder with the plurality of bodies, a housing receiving the LED driver therein, and a heat sink connected with the housing for cooling the LED driver. The heat sink includes a first section and a pair of second sections. The first section is positioned between the pair of second sections, and the housing is mounted between the pair of second sections and opposite to the first section. The first section, the pair of second sections and the housing cooperatively form an elliptical-sectional cylinder. The first section includes a plurality of horizontal first passageways and each second section includes a second passageway. The plurality of first passageways and the second passageway are provided to heat dissipation for the LED light.

Wherein the LED light further includes a connecting plate connected with a first portion of the heat sink, a case tightly connected with the connecting plate and a connecting member, one end of the connecting member tightly connects with the case, and the other end of the connecting member movably connects with the holder, when the holder is installed on an external device, the connecting plate, the case and the heat sink rotate together with the connecting member during rotating the connecting member.

Wherein the LED light further includes a baseboard tightly connected with a second portion of the heat sink, the second portion is opposite to the first portion.

Wherein the baseboard includes a plurality of horizontal first through-holes and a second through-hole, the first through-holes connect with the first passageways and the second through-hole connects with the second passageway.

Wherein the cross-section of the first passageway is rectangular and the cross-section of the second passageway is semicircular.

Wherein the first section and the second section respectively include a receiving groove for receiving the body therein.

Wherein the plurality of bodies surround together to form a semicircular cross-section.

Wherein the first section includes a sliding groove and each second section includes a mounting portion sliding in the sliding groove for connecting the first section with the pair of second sections.

Wherein the second section further includes a cooling portion exposed outside of the heat sink, one end of the cooling portion is adjacent to the housing, and the other end of the cooling portion is close to the plurality of the bodies.

Wherein the LED light further includes a wiring plate received in the case, the wiring plate is configured for electrically connecting to the holder, the LED driver and the plurality of bodies.

Wherein the housing is mounted on the side of the heat sink through a locking screw, a gap is formed between the peripheral of the housing and the heat sink.

Wherein the housing is a pentagonal cross-section and includes a plurality of sidewalls and a receiving room surrounded by the plurality of sidewalls, a semicircular third through-hole is formed on two adjacent sidewalls and extends from the top of the sidewall to the bottom of the sidewall, two opposite ends of the third through-hole respectively defines internal threads therein for threadedly connecting the housing with the heat sink.

Wherein the housing further includes a triangular wiring recess for providing electrical connection between the LED driver and the holder and the bodies received in the housing to avoid the lines of the LED driver and the holder and the bodies redundish.

In another aspect, an LED light according to an exemplary embodiment of the present disclosure includes a holder and a plurality of bodies electrically connected to the holder. The LED light further includes an LED driver electrically connected the holder with the plurality of bodies, a housing receiving the LED driver therein, and a heat sink connected with the housing for cooling the LED driver. The heat sink includes a first section and a pair of second sections. The first section is positioned between the pair of second sections, and the housing is mounted between the pair of second sections and opposite to the first section. The first section, the pair of second sections and the housing cooperatively form an elliptical-sectional cylinder. The first section includes a plurality of horizontal first passageways and each second section includes a second passageway. The plurality of first passageways and the second passageway are provided to heat dissipation for the LED light. The housing is mounted on the side of the heat sink through a locking screw, a gap is formed between the peripheral of the housing and the heat sink.

Wherein the housing is a pentagonal cross-section and includes a plurality of sidewalls and a receiving room surrounded by the plurality of sidewalls, a semicircular third through-hole is formed on two adjacent sidewalls and extended from the top of the sidewall to the bottom of the sidewall, two opposite ends of the third through-hole respectively defines internal threads therein for threadedly connecting the housing with the heat sink, the housing further includes a triangular wiring recess for providing electrical connection between the LED driver and the holder and the bodies received in the housing to avoid the lines of the LED driver and the holder and the bodies redundish.

Wherein the LED light further includes a connecting plate connected with a first portion of the heat sink, a case tightly connected with the connecting plate and a connecting member, one end of the connecting member tightly connects with the case, and the other end of the connecting member movably connects with the holder, when the holder is installed on an external device, the connecting plate, the case and the heat sink rotate together with the connecting member during rotating the connecting member.

Wherein the LED light further includes a baseboard tightly connected with a second portion of the heat sink, the second portion is opposite to the first portion.

Wherein the baseboard includes a plurality of horizontal first through-holes and a second through-hole, the first through-holes connect with the first passageways and the second through-hole connects with the second passageway, the cross-section of the first passageway is rectangular and the cross-section of the second passageway is semicircular.

Wherein the first section and the second section respectively include a receiving groove for receiving the body therein, the first section includes a sliding groove, each second section includes a mounting portion sliding in the sliding groove for connecting the first section with the pair of second sections, and a cooling portion exposed outside of the heat sink, one end of the cooling portion is adjacent to the housing, and the other end of the cooling portion is close to the plurality of the bodies.

The present disclosure provides the advantages as below.

Such configuration of the housing is mounted on the side of the heat sink to provide enough space for receiving the LED driver therein, which may avoid crush the LED driver and improve the lifespan of the LED light. In addition, the first and second passageways are provided to improve heat dissipation effects.

DETAILED DESCRIPTION

Figure 1:
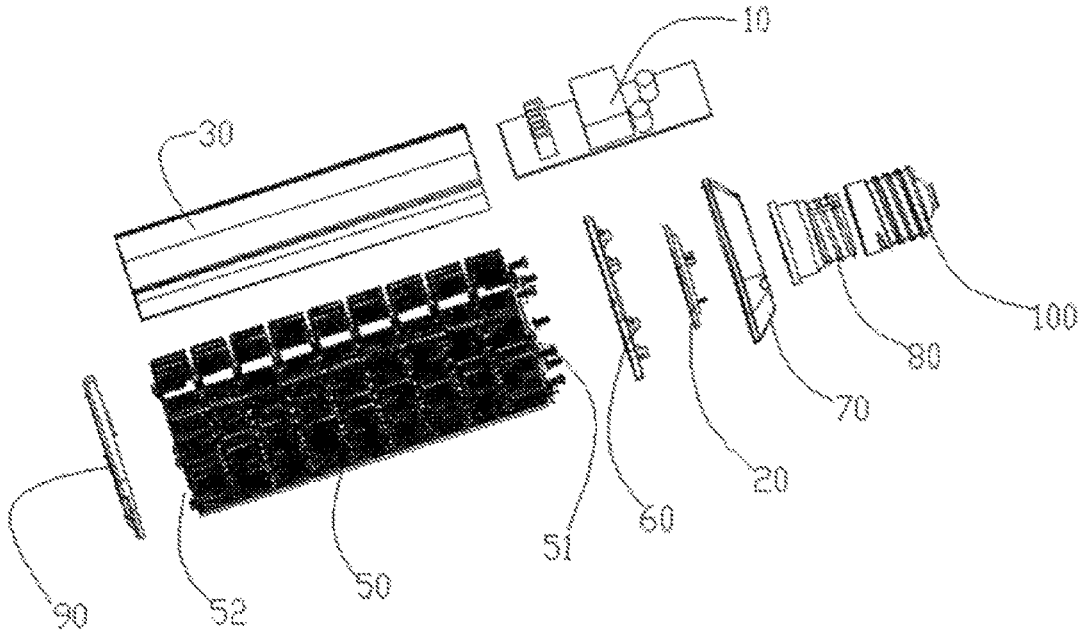
FIG. 1 is an exploded schematic view of the LED light in accordance with an embodiment.

The disclosure is illustrated by way of example and not by way of limitation in the figures of the accompanying drawings, in which like reference numerals indicate similar elements.

Referring to FIG. 1, the LED light includes a holder 100, an LED driver 10, a housing 30, a plurality of bodies 40 and a heat sink 50. The LED driver 10 is received in the housing 30. The LED driver 10 electrically connects with the holder 100 and the plurality of bodies 40. The housing 30 connects with the heat sink 50. The plurality of bodies 40 electrically connects with the holder 100.

Figure 2:
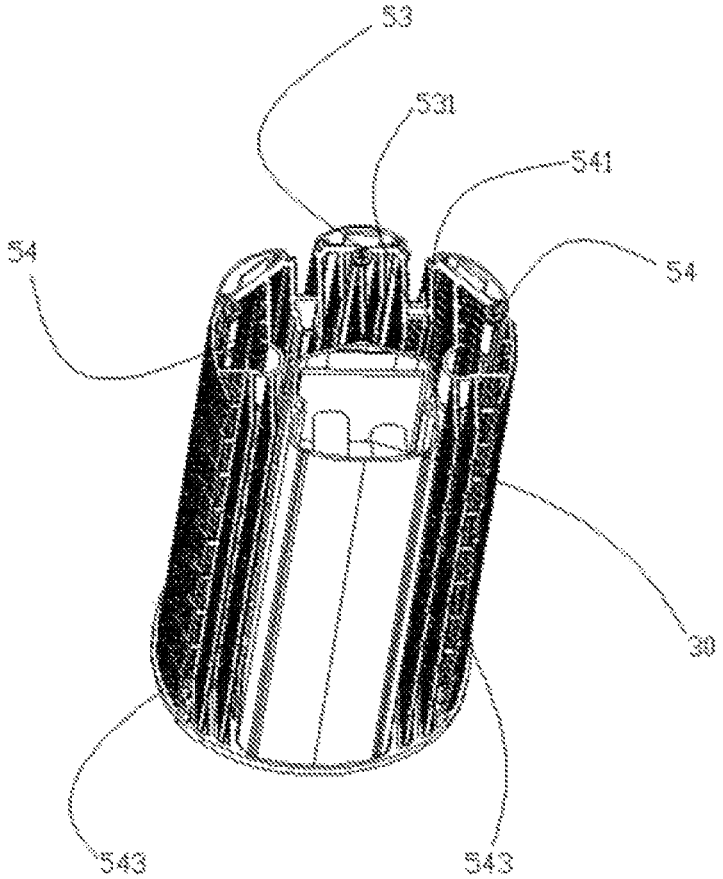
FIG. 2 is a schematic view of a heat sink and a housing of the LED light of FIG. 1.
Figure 3:
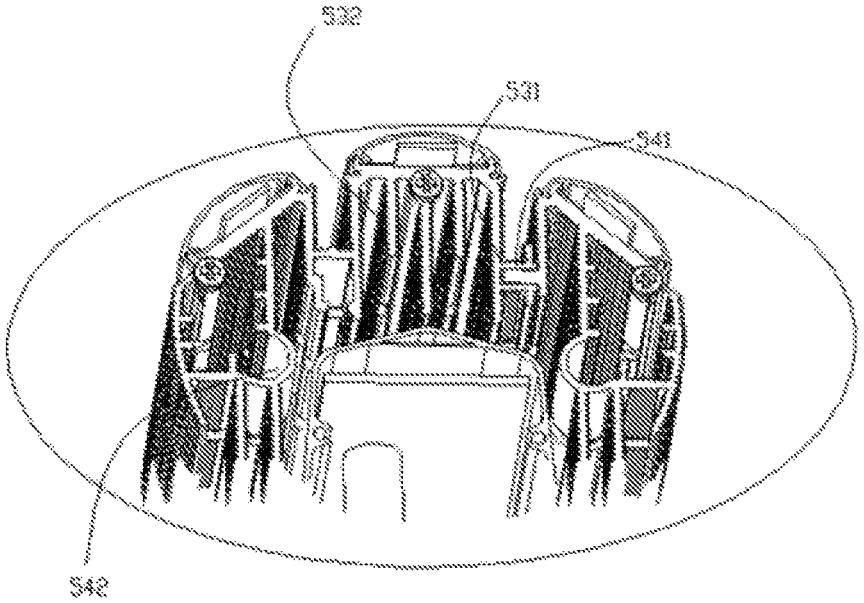
FIG. 3 is a partial enlarged schematic view of the heat sink and the housing of the LED light of FIG. 1.

Referring to FIGS. 2-3, the heat sink 50 includes a first section 53 and a pair of second sections 54. The first section 53 is positioned between the pair of second sections 54 and opposite to the housing 30. The first section 53, the pair of second sections 54 and the housing 30 cooperatively form an elliptical-sectional cylinder. The first section 53 includes a plurality of horizontal first passageways 532 and each second section 54 includes a second passageway 542. The plurality of first passageways 532 and the second passageway 542 are cooperatively provided to heat dissipation for the LED light. In the present embodiment of the disclosure, the cross-section of the first passageway 532 is rectangular and the cross-section of the second passageway 542 is semicircular. The housing 30 is mounted on the side of the heat sink 50 through a locking screw. A gap is formed between the peripheral of the housing 30 and the heat sink 50.

Figure 7:
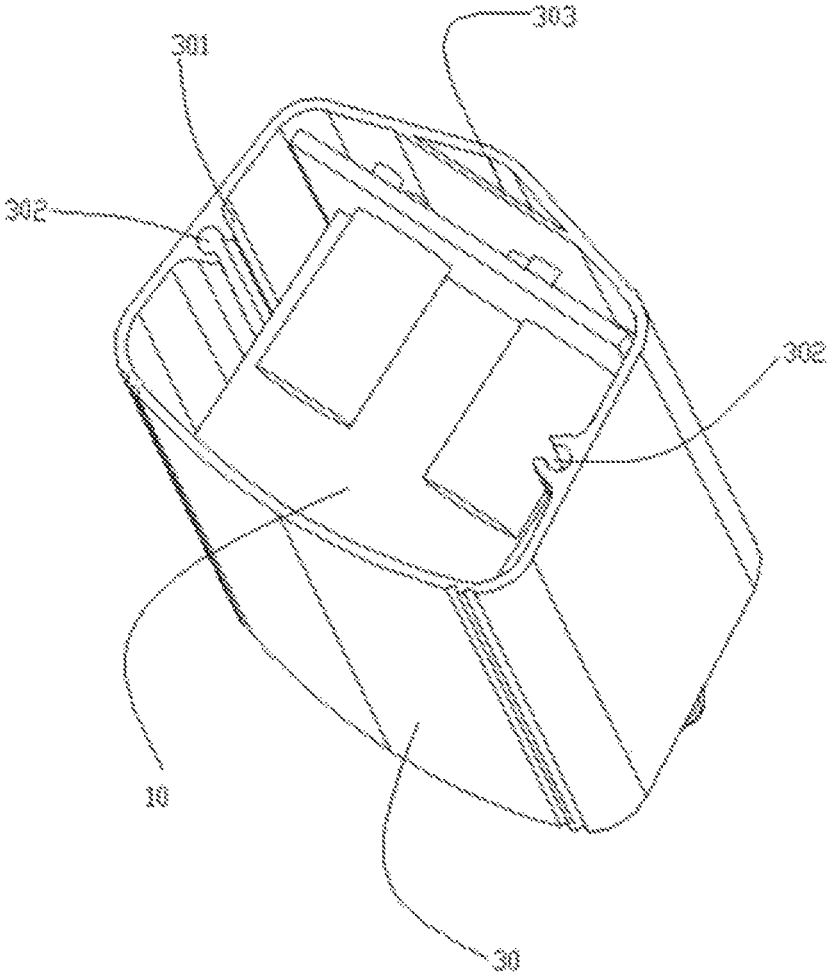
FIG. 7 is a schematic view of the housing and an LED driver of the LED light of FIG. 1, focused on showing the LED driver received in the housing.

Referring to FIG. 7, the cross-section of the housing 30 is pentagonal. The housing 30 includes a plurality of sidewalls 301 and a receiving room (not labeled) surrounded by the plurality of sidewalls 301. A semicircular third through-hole 302 is formed on two adjacent sidewalls 301. In the present embodiment of the disclosure, the amount of the third through-hole 302 is two. The third through-hole 302 is extended from the top of the sidewall 301 to the bottom of the sidewall 301. Two opposite ends of the third through-hole 302 respectively defines internal threads therein for threadedly connecting the housing 30 with the heat sink 50. The housing 30 further includes a wiring recess 303 for providing electrical connection between the LED driver 10 and the holder 100 and the bodies 40 received in the housing 30, thereby avoiding the lines of the LED driver 10 and the holder 100 and the bodies 40 redundish. In the present embodiment of the disclosure, the cross-section of the wiring recess 303 is triangular. The height of the housing 30 is same as the height of the heat sink 50, thereby the housing 30 may protect and support the LED driver 10 because the LED driver 10 is mounted on the housing 30 through glue. When the LED driver 10 is mounted on the housing 30, first, the AB glue is brushed on the inner wall of the housing 30. Second, the LED driver 10 is positioned above the AB glue. Thus, the LED driver 10 is tightly received in the receiving room of the housing 30 after the AB glue is dried. The LED driver 10 may provide a constant current for the LED light when the power voltage supplied on the LED light is changed, thereby improve the lifespan of the LED light and ensure the brightness of the LED light. Such housing 30 is mounted on the side of the heat sink 50 to provide enough space for receiving the LED driver 10 therein, which may avoid crush the LED driver 10 and receive various types of the LED driver 10. The heat sink 50 cools the LED driver 10, thus improve the lifespan of the LED driver 10 and the LED light.

In the present embodiment of the disclosure, the cross-section of the first passageway 532 is rectangular, and the cross-section of the second passageway 542 is semicircular. In this way, the plurality of first passageways 532 with multiple long strips configuration, together with the semicircular second passageway 542 increases the area of the heat exchange between the heat sink 50 and the outside, thereby improve the efficiency of internal heat dissipation of the LED light.

The LED light further includes a connecting plate 60, a case 70 and a connecting member 80. The connecting plate 60 tightly connects with a first portion 51 of the heat sink 50. The case 70 tightly connects with the connecting plate 60. One end of the connecting member 80 tightly connects with the case 70, and the other end of the connecting member 80 movably connects with the holder 100. When the holder 100 is installed on an external device (not shown), the connecting plate 60, the case 70 and the heat sink 50 rotate together with the connecting member 80 during rotation of the connecting member 80.

In the present embodiment of the disclosure, the connecting plate 60 is plastic material and tightly connects the heat sink 50 with the case 70. The connecting plate 60, the heat sink 50 and the case 70 are fixed together by screws, thereby a simple operation and a firm and compact installation are obtained. One end of the connecting member 80 tightly connects with the case 70, and the other end of the connecting member 80 movably connects with the holder 100. In this way, the connecting member 80 may rotate relative to the holder 100. When the connecting member 80 rotates, the connecting plate 60, the case 70 and the heat sink 50 rotate together with the connecting member 80. Because the holder 100 is a spiral configuration instead of a straight configuration. The light angle of the LED light is 180 degree. In this way, when installing the LED light, it is possible to rotate the luminescent part to the back of the LED light, thereby causing the LED light unable to use. In the present embodiment of the disclosure, when the holder 100 is installed on the external device, the connecting member 80 may optically rotate relative to the holder 100 to adjust the plurality of bodies 40 to their appropriate positions, thus it is no need to worry about the installation angle of the bodies 40 which ensure the LED light on it's normal work.

Figure 4:
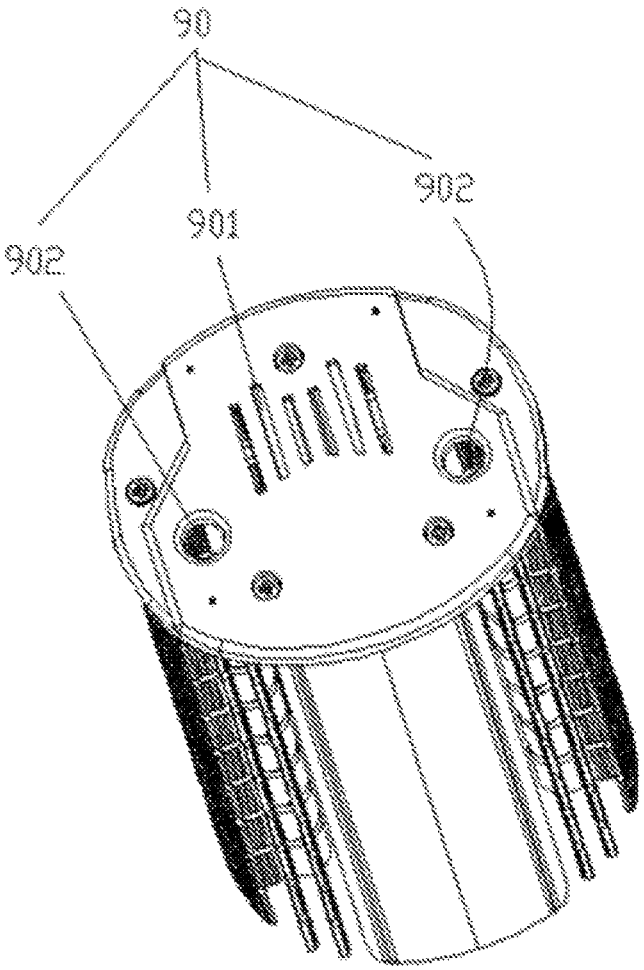
FIG. 4 is a schematic view of a baseboard of the LED light of FIG. 1.

Referring to FIG. 4, the LED light further includes a baseboard 90 mounted on a second portion 52 of the heat sink 50. The second portion 52 is opposite to the first portion 51. The baseboard 90 includes a plurality of horizontal first through-holes 901 and a second through-hole 902. The first through-holes 901 connect with the first passageways 532, while the second through-hole 902 connects with the second passageway 542.

In the present embodiment of the disclosure, the baseboard 90 is mounted on the second portion 52 of the heat sink 50 so as to protect and support the heat sink 50. The first through-holes 901 connect with the first passageways 532, and the second through-hole 902 connects with the second passageway 542. In this way, the heat produced by the first section 53 transmits to the first through-holes 901 from the first passageways 532, and the heat produced by the second section 54 transmits to the second through-hole 902 from the second passageway 542, thereby the heat release from the heat sink 50 is realized.

Figure 5:
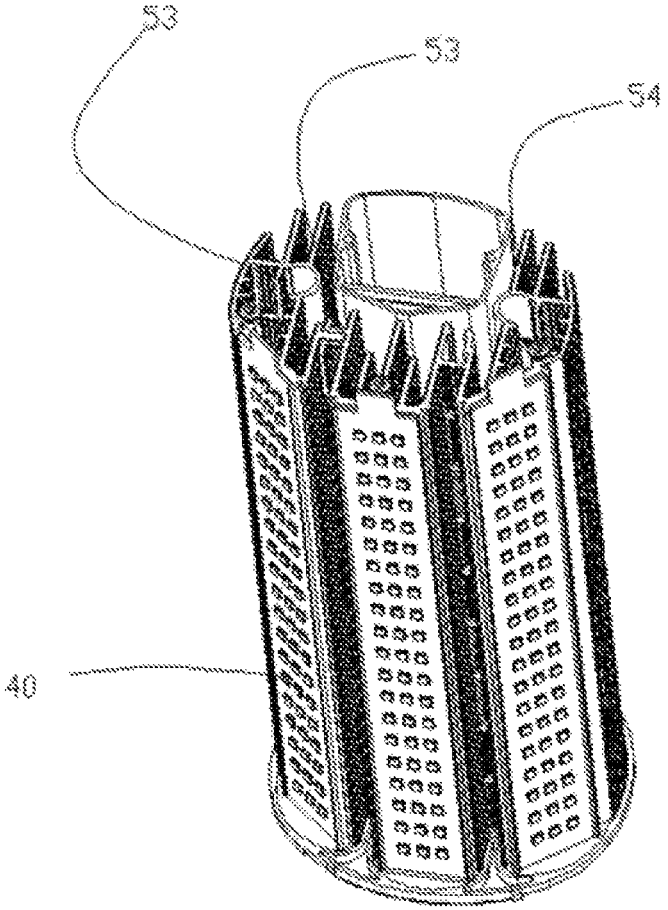
FIG. 5 is a partial schematic view of the LED light of FIG. 1, focused on showing a first section, a pair of second sections and a body thereof.
Figure 6:
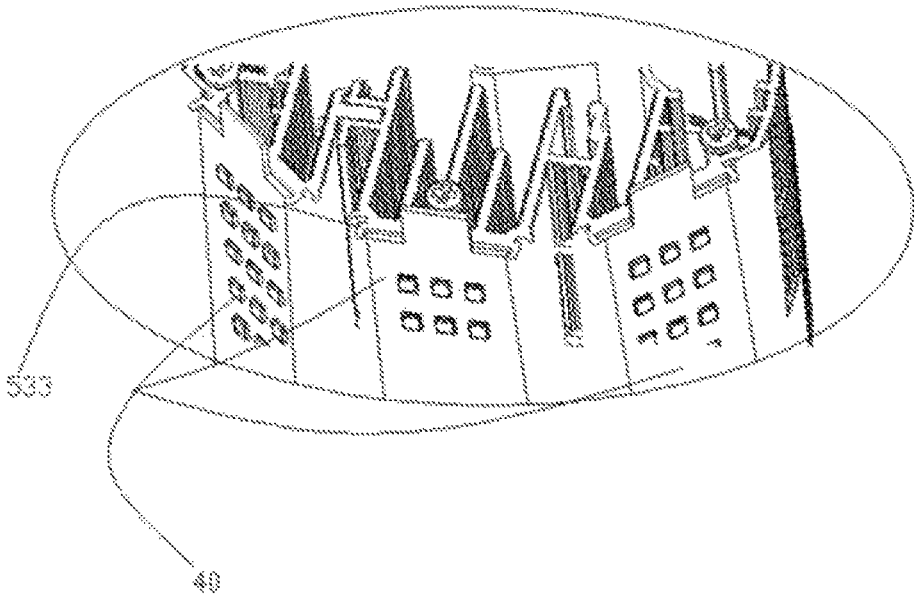
FIG. 6 is a partial enlarged schematic view of the LED light of FIG. 1, focused on showing the body and a receiving groove thereof.

Referring to FIGS. 5-6, the first section 53 and the second section 54 respectively include a receiving groove 533 for receiving the plurality of bodies 40 therein. The plurality of bodies 40 surround together to form a semicircular cross-section.

In the present embodiment of the disclosure, the body 40 includes a plurality of LEDs (not labeled) for emitting light. The bottom plate of the body 40 is aluminum plate. The plurality of bodies 40 is inserted into the corresponding receiving grooves 533 when the plurality of bodies 40 is installed. The length of the receiving groove 533 is same as the height of the heat sink 50 so that the length of the body 40 is equal to the length of the receiving groove 533. In the present embodiment of the disclosure, there are three receiving grooves 533, so the amount of the body 40 is also three. The three bodies 40 surround to form a semicircle to emit light at a light angle with 180 degree.

Referring to FIG. 3, each first section 53 includes a sliding groove 531 and each second section 54 includes a mounting portion 541 sliding in a corresponding sliding groove 531 for tightly connecting the first section 53 with the pair of second sections 54.

Because the amount of the second sections 54 is two, so the sliding groove 531 is formed on two sides of the first section 53. When connecting the first section 53 with the second sections 54, the mounting portion 541 slides on the sliding groove 531, thereby the second sections 54 is quickly and easily connected with the first section 53. The configuration of the sliding groove 531 limits the lateral movement of the second sections 54 along its transverse direction. The mounting portion 541 is slidably received in the sliding groove 531 to improve reliable connection between the first section 53 and the second sections 54.

Referring to FIG. 2, the second section 54 further includes a cooling portion 543 exposed outside of the heat sink 50. One end of the cooling portion 543 is adjacent to the housing 30, and the other end of the cooling portion 543 is close to the plurality of the bodies 40. In the present embodiment of the disclosure, the cooling portion 543 includes three cooling fins (not labeled) arranged in a sequentially superimposed way. A gap (not shown) is formed between two adjacent cooling fins. On the one hand, such cooling portion 543 may improve the beautiful shape of the LED light, and on the other hand, the heat dissipation performance of the heat sink 50 may be further enhanced.

The LED light further includes a wiring plate 20 received in the case 70. The wiring plate 20 is configured for electrically connecting to the holder 100, the LED driver 10 and the plurality of bodies 40. In the present embodiment of the disclosure, the wiring plate 20, the holder 100, the LED driver 10 and the plurality of bodies 40 cooperatively form a completed circuit.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An LED light comprising:

a holder;

a plurality of bodies electrically connected to the holder;

an LED driver electrically connected with the holder and the plurality of bodies;

a housing configured for receiving the LED driver therein;

a heat sink connected with the housing for cooling the LED driver, the heat sink comprising a first section and a pair of second sections; wherein the first section is positioned between the pair of second sections and the housing is positioned between the pair of second sections and opposite to the first section, wherein the first section, the pair of second sections and the housing cooperatively form an elliptical-sectional cylinder, the first section comprises a plurality of first passageways arranged in parallel, and each second section comprises a second passageway, thereby the plurality of first passageways and the second passageway are provided to heat dissipation for the LED light, and wherein the heat sink is arranged to surround at least a part of a periphery of the housing.

2. The LED light as claimed in claim 1, wherein the LED light further comprises a connecting plate connected with a first portion of the heat sink, a case tightly connected with the connecting plate and a connecting member, one end of the connecting member tightly connects with the case, and the other end of the connecting member movably connects with the holder, when the holder is installed on an external device, the connecting plate, the case and the heat sink rotate together with the connecting member during rotating the connecting member.

3. The LED light as claimed in claim 2, wherein the LED light further comprises a baseboard tightly connected with a second portion of the heat sink, the second portion is opposite to the first portion.

4. The LED light as claimed in claim 3, wherein the baseboard comprises a plurality of horizontal first through-holes and a second through-hole, the first through-holes connect with the first passageways and the second through-hole connects with the second passageway.

5. The LED light as claimed in claim 4, wherein the cross-section of the first passageway is rectangular and the cross-section of the second passageway is semicircular.

6. The LED light as claimed in claim 2, wherein the LED light further comprises a wiring plate received in the case, the wiring plate is configured for electrically connecting to the holder, the LED driver and the plurality of bodies.

7. The LED light as claimed in claim 1, wherein the first section and the second section respectively comprise a receiving groove for receiving at least one of the plurality of bodies therein.

8. The LED light as claimed in claim 7, wherein the plurality of bodies surround together to form a semicircular cross-section.

9. The LED light as claimed in claim 1, wherein the first section comprises a sliding groove and each second section comprises a mounting portion sliding in the sliding groove for connecting the first section with the pair of second sections.

10. The LED light as claimed in claim 9, wherein the second section further comprises a cooling portion exposed outside of the heat sink, one end of the cooling portion is adjacent to the housing, and the other end of the cooling portion is close to the plurality of the bodies.

11. The LED light as claimed in claim 1, wherein the housing is mounted on the side of the heat sink through a locking screw, a gap is formed between the peripheral of the housing and the heat sink.

12. The LED light as claimed in claim 11, wherein the housing is a pentagonal cross-section and includes a plurality of sidewalls and a receiving room surrounded by the plurality of sidewalls, a semicircular third through-hole is formed on two adjacent sidewalls and extends from the top of the sidewall to the bottom of the sidewall, two opposite ends of the third through-hole respectively defines internal threads therein for threadedly connecting the housing with the heat sink.

13. The LED light as claimed in claim 12, wherein the housing further includes a triangular wiring recess for providing electrical connection between the LED driver and the holder and the bodies received in the housing to avoid the lines of the LED driver and the holder and the bodies to avoid redundancy of the lines of the LED driver in the holder and in the bodies.

14. An LED light comprising:

a holder;

a plurality of bodies electrically connected to the holder;

an LED driver electrically connected with the holder and the plurality of bodies;

a housing configured for receiving the LED driver therein;

a heat sink connected with the housing for cooling the LED driver, the heat sink comprising a first section and a pair of second sections; wherein the first section is positioned between the pair of second sections and the housing is positioned between the pair of second sections and opposite to the first section, wherein the first section, the pair of second sections and the housing cooperatively form an elliptical-sectional cylinder, the first section comprises a plurality of first passageways arranged in parallel, and each second section comprises a second passageway, thereby the plurality of first passageways and the second passageway are provided to heat dissipation for the LED light; wherein the housing is mounted on the side of the heat sink through a locking screw, a gap is formed between the peripheral of the housing and the heat sink.

15. The LED light as claimed in claim 14, wherein the housing is a pentagonal cross-section and comprises a plurality of sidewalls and a receiving room surrounded by the plurality of sidewalls, a semicircular third through-hole is formed on two adjacent sidewalls and extended from the top of the sidewall to the bottom of the sidewall, two opposite ends of the third through-hole respectively defines internal threads therein for threadedly connecting the housing with the heat sink, the housing further comprises a triangular wiring recess for providing electrical connection between the LED driver and the holder and the bodies received in the housing to avoid the lines of the LED driver and the holder and the bodies to avoid redundancy of the lines of the LED driver in the holder and in the bodies.

16. The LED light as claimed in claim 15, wherein the LED light further comprises a connecting plate connected with a first portion of the heat sink, a case tightly connected with the connecting plate and a connecting member, one end of the connecting member tightly connects with the case, and the other end of the connecting member movably connects with the holder, when the holder is installed on an external device, the connecting plate, the case and the heat sink rotate together with the connecting member during rotating the connecting member.

17. The LED light as claimed in claim 16, wherein the LED light further comprises a baseboard tightly connected with a second portion of the heat sink, the second portion is opposite to the first portion.

18. The LED light as claimed in claim 17, wherein the baseboard comprises a plurality of horizontal first through-holes and a second through-hole, the first through-holes connect with the first passageways and the second through-hole connects with the second passageway, the cross-section of the first passageway is rectangular and the cross-section of the second passageway is semicircular.

19. The LED light as claimed in claim 18, wherein the first section and the second section respectively comprise a receiving groove for receiving at least one of the plurality of bodies therein, the first section comprises a sliding groove, each second section comprises a mounting portion sliding in the sliding groove for connecting the first section with the pair of second sections, and a cooling portion exposed outside of the heat sink, one end of the cooling portion is adjacent to the housing, and the other end of the cooling portion is close to the plurality of the bodies.

* * * * *